US008297153B2

(12) United States Patent
Mueller

(10) Patent No.: US 8,297,153 B2
(45) Date of Patent: Oct. 30, 2012

(54) MOUNTING AND DISMOUNTING DEVICE FOR CYLINDRICAL BODIES

(75) Inventor: Michael Mueller, Bad Staffelsdein (DE)

(73) Assignee: Mueller-Kueps, L.P., Tucker, GA (US)

( * ) Notice: Subject to any disclaimer, the term of this patent is extended or adjusted under 35 U.S.C. 154(b) by 291 days.

(21) Appl. No.: 12/851,763

(22) Filed: Aug. 6, 2010

(65) Prior Publication Data

US 2012/0031241 A1 Feb. 9, 2012

(51) Int. Cl.
*B25B 13/12* (2006.01)
*B25B 13/50* (2006.01)

(52) U.S. Cl. ..... 81/92; 81/98; 81/179

(58) Field of Classification Search ..... 81/92–94, 81/96, 120, 111, 113, 179, 186, 64, 3.43, 81/3.4, 68, 69, 177.1, 177.2, 177.85
See application file for complete search history.

(56) References Cited

U.S. PATENT DOCUMENTS

| | | | | |
|---|---|---|---|---|
| 1,401,484 | A * | 12/1921 | Mitchell | 81/100 |
| 3,774,481 | A * | 11/1973 | Goodman | 81/57.13 |
| 4,987,804 | A * | 1/1991 | Greenawalt | 81/64 |
| 5,440,955 | A * | 8/1995 | Freeland | 81/64 |
| 6,125,723 | A * | 10/2000 | Huang | 81/64 |
| 7,024,971 | B2 * | 4/2006 | Stanton | 81/179 |
| 7,278,340 | B2 * | 10/2007 | Furnish | 81/98 |

* cited by examiner

*Primary Examiner* — Robert Pezzuto
(74) *Attorney, Agent, or Firm* — Rosenberg, Klein & Lee

(57) ABSTRACT

A mounting and dismounting device for cylindrical bodies comprises a fixing element, a moving element, and a buckling element. The fixing element connects to the moving element on both sides to form a hole. The cylindrical body is then inserted into the hole. A buckling part of the buckling element pivotally connects to the fixing element. One lifts a lifting part for the buckling element to urge against the cylindrical body in the hole. By lifting the lifting part, the cylindrical body can be mounted or dismounted.

4 Claims, 7 Drawing Sheets

MOUNTING AND DISMOUNTING DEVICE FOR CYLINDRICAL BODIES

BACKGROUND OF THE INVENTION

1. Field of Invention

The invention relates to a mounting and dismounting tool and, in particular, to a mounting and dismounting device for cylindrical bodies.

2. Related Art

FIG. 7 shows a conventional mounting and dismounting device. It consists of a hollow ring 90 and a buckling element 91. The buckling element 91 is pivotally provided to the side of the ring 90. One end of the buckling element 91 has a buckling part 92 that extends into the ring 90. The ring 90 is then mounted on a cylindrical body 93. The buckling element 91 is rotated to urge against the cylindrical body 93. This mechanism is used to mount or dismount the cylindrical body 93.

However, the above-mentioned mounting and dismounting device for cylindrical bodies has to have the right size for the cylindrical body in order to work. If there are cylindrical bodies of two or more different sizes, then different mounting and dismounting devices are required. This is quite inconvenient for users to carry and operate.

Beside, the ring 90 has to be mounted from one end of the cylindrical body 93. If the end of the cylindrical body 93 is blocked by some object, the ring 90 cannot be mounted. This becomes a difficulty for mounting or dismounting the cylindrical body 93.

It is thus imperative to provide a more convenient mounting and dismounting device for cylindrical bodies.

SUMMARY OF THE INVENTION

In view of the foregoing, an objective of the invention is to provide a mounting and dismounting device that can be used on cylindrical bodies of different diameter sizes. It makes the task of mounting and dismounting cylindrical bodies much easier and smoother.

To achieve the above-mentioned objective, the invention includes: a fixing element, a moving element and a buckling element.

The fixing element has a semicircular shape. Both ends of the fixing element extend out a protruding part, respectively. Each of the protruding parts has a first through hole in the longitudinal direction. A horizontal groove goes through both sides of the fixing element. One end of the horizontal groove has a second through hole penetrating through the horizontal groove.

The moving element also has a semicircular shape. Both ends of the moving element have a recess part inward, respectively. The protruding parts of the fixing element are embedded into the two recess parts. Both ends of the moving element have a third through hole through the recess part, respectively. The first through hole of the protruding part is connected with the corresponding third through hole. A pivotal axis and a positioning axis go through the first through hole and the corresponding third through hole, respectively, so that a hole forms between the fixing element and the moving element for a cylindrical body to mount. The positioning axis can be withdrawn from the first through hole and the third through hole.

One end of the buckling element has a buckling part in the shape of a cam. The rim of the buckling part has teeth. The other end of the buckling part has a lifting part that lifts when urging. The buckling part has a fourth through hole in the longitudinal direction. The lifting part further has a mounting hole for an auxiliary tool to connect and to lift. The buckling part of the buckling element extends into the horizontal groove of the fixing element. The fourth through hole and the second through hole of the fixing element are connected and penetrated through by another pivotal axis. When pivotally swinging, the buckling part goes into the through hole in an appropriate depth to urge against the cylindrical body.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
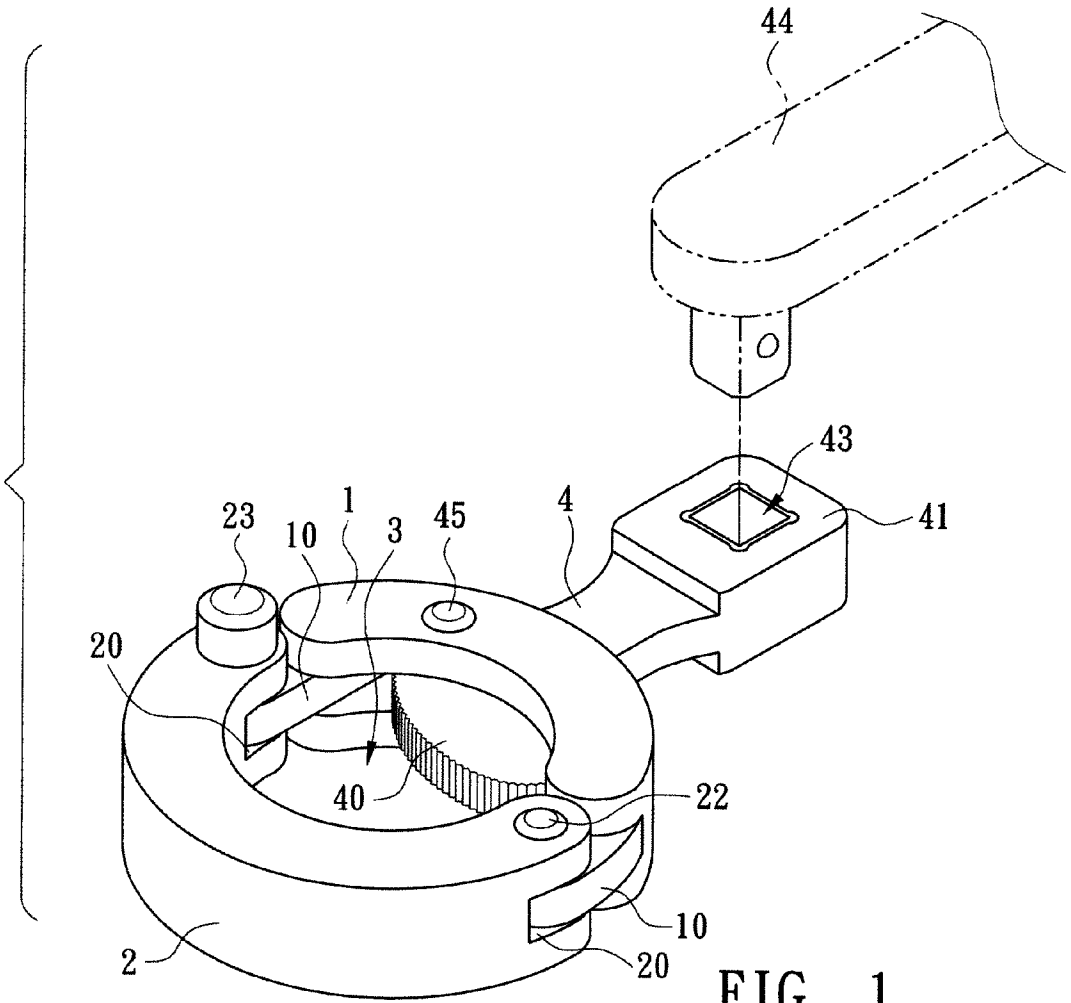
FIG. 1 is a three-dimensional exploded view of the invention.
Figure 2:
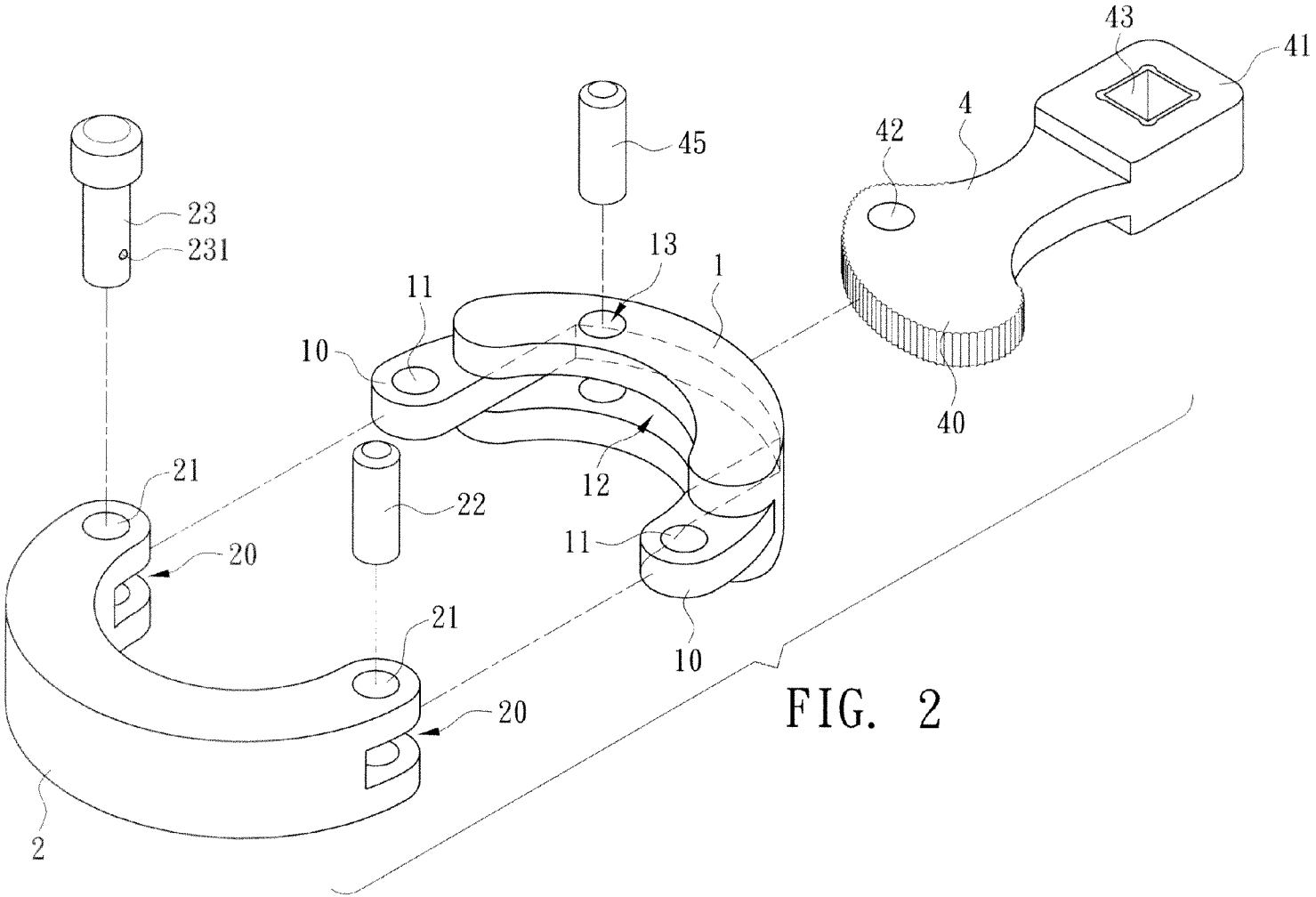
FIG. 2 is a three-dimensional perspective view of the invention.

Please refer to FIGS. 1 to 5 for a first embodiment of the invention. The invention, however, is not restricted by the structure of this particular example. The structure of the first embodiment is shown in FIGS. 1 and 2.

The mounting and dismounting device for cylindrical bodies in this embodiment includes a fixing element 1, a moving element 2, and a buckling element 4.

The fixing element 1 has a semicircular shape. In this embodiment, it has an integrally formed block structure. Both ends of the fixing element 1 extend out a protruding part 10, respectively. Each of the protruding parts 10 has a first through hole 11 in the longitudinal direction. A horizontal groove 12 goes through both sides of the fixing element 1. One end of the horizontal groove 12 has a second through hole 13 penetrating through the horizontal groove 12.

Figure 3:
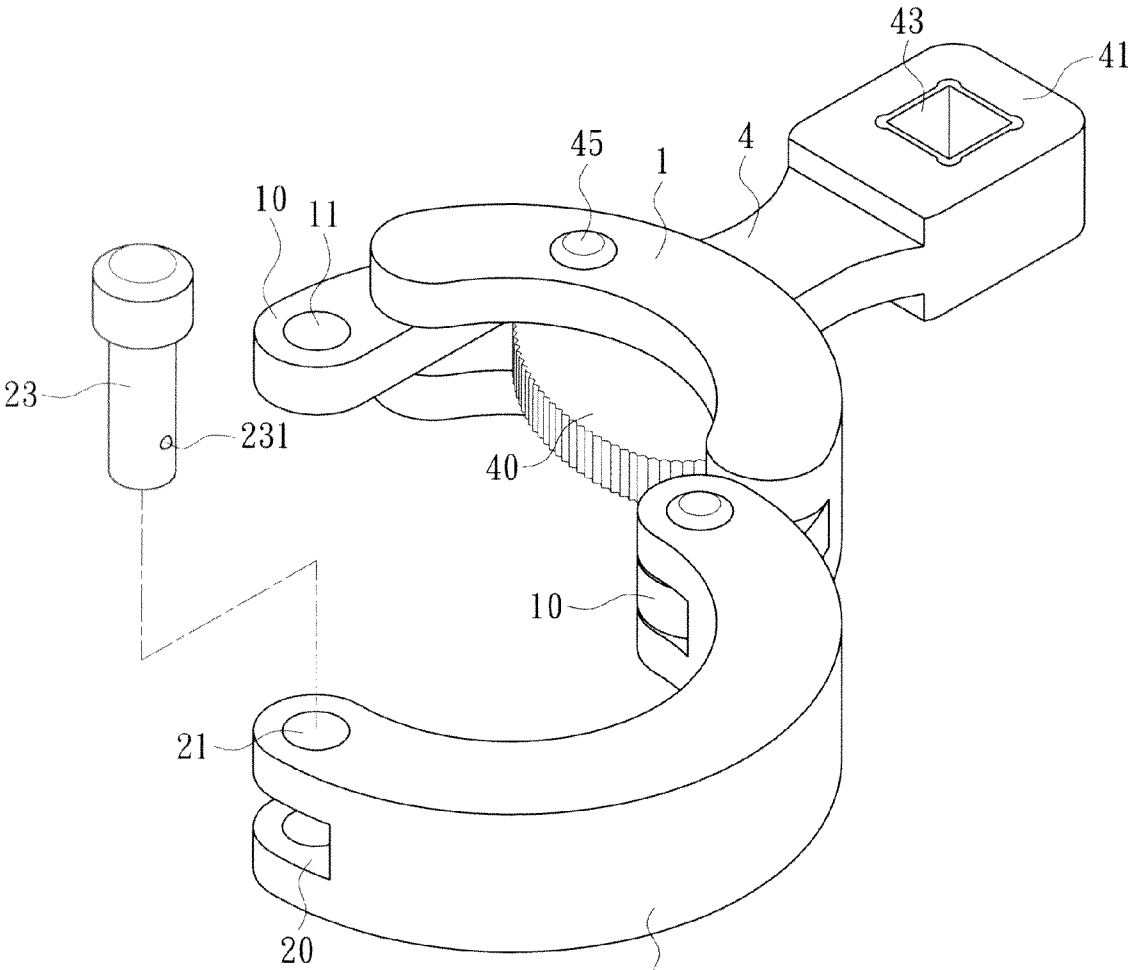
FIG. 3 is a planar view of the invention when the moving element is opened.

The moving element 2 also has a semicircular shape. In this embodiment, it also has an integrally formed block structure. Both ends of the moving element 2 have a recess part 20 inward, respectively. The protruding parts 10 of the fixing element 1 are embedded into the two recess parts 20. Both ends of the moving element 2 have a third through hole 21 through the recess part 20, respectively. The first through hole 11 of the protruding part 10 is connected with the corresponding third through hole 21. A pivotal axis 22 and a positioning axis 23 go through the first through hole 11 and the corresponding third through hole 21, respectively, so that a hole 3 forms between the fixing element 1 and the moving element 2 for a cylindrical body to mount. The positioning axis 23 can be withdrawn from the first through hole 11 and the third through hole 21. The positioning axis 23 is shown in FIG. 1. In this embodiment, it has a ball 231 for positioning. The ball 231 is urged by a compressive spring (not shown) in the positioning axis 23. Therefore, the positioning axis 23 can be withdrawn from the first through hole 11 and the third through hole 21, depending upon whether the ball 231 moves in or out. As shown in FIG. 3, the moving element 2 can open as it pivotally rotate with respect to the fixing element 1.

One end of the buckling element 4 has a buckling part 40 in the shape of a cam. The rim of the buckling part 40 has teeth. The other end of the buckling part 40 has a lifting part 41 that lifts when urging. The buckling part 40 has a fourth through hole 42 in the longitudinal direction. The lifting part 41 further has a mounting hole 43 for an auxiliary tool 44 to connect and to lift. The buckling part 41 of the buckling element 4 extends into the horizontal groove 12 of the fixing element 1. The fourth through hole 42 and the second through hole 13 of the fixing element 1 are connected and penetrated through by another pivotal axis 45. When pivotally swinging, the buckling part 40 goes into the through hole 3 in an appropriate depth to urge against the cylindrical body.

The above-mentioned structure shows that to mount a cylindrical body, one simply takes off the positioning axis 23 to separate one end of the fixing element 1 and the moving element 2, inserts the cylindrical body, and then uses the positioning axis 23 again. When mounting or dismounting the cylindrical body, one lifts the buckling element 4 so that the buckling part 40 on one end urges against the cylindrical body with its rim. The user can then mount or dismount by inserting a force in the turning direction.

Figure 4:
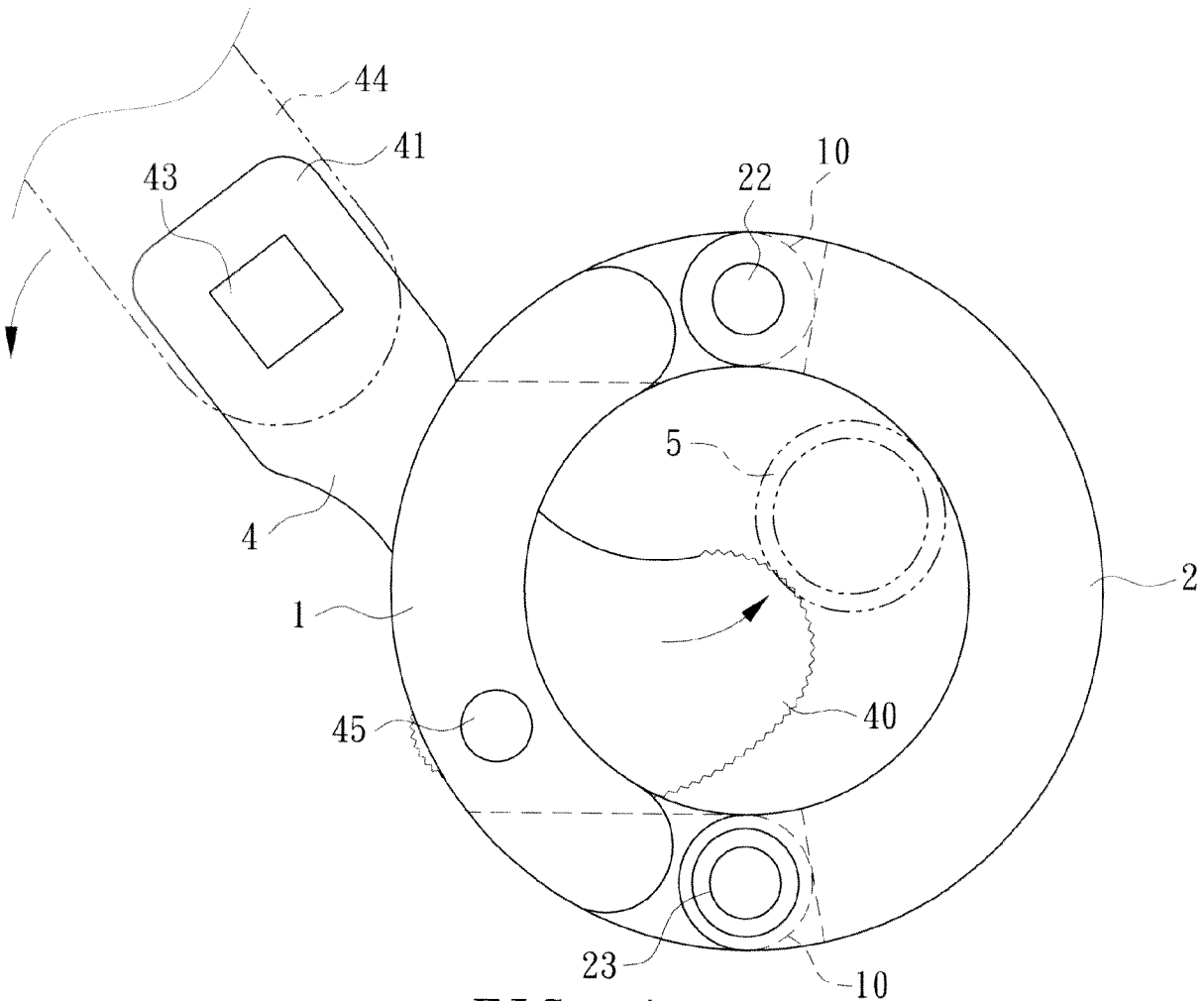
FIG. 4 is a schematic view of mounting and dismounting a smaller cylindrical body according to the invention.
Figure 5:
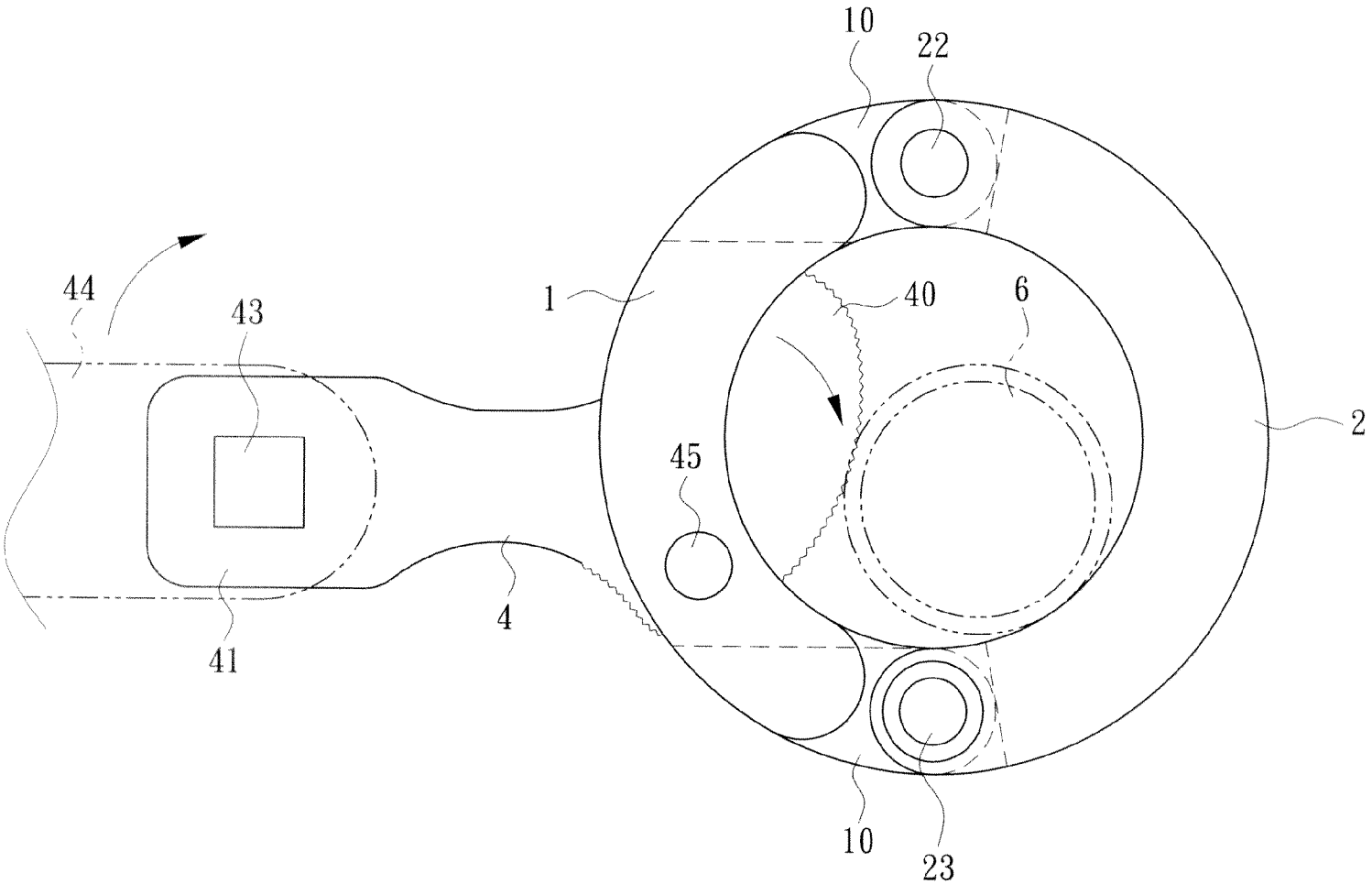
FIG. 5 is a schematic view of mounting and dismounting a larger cylindrical body according to the invention.

FIGS. 4 and 5 show the actual operations of the disclosed mounting and dismounting device in the first embodiment. There are a cylindrical body 5 and a cylindrical body 6 in FIGS. 4 and 5, respectively. The diameter of the cylindrical body 5 in FIG. 4 is apparently smaller than that of the cylindrical body 6 in FIG. 5. After inserting the CB5 and the cylindrical body 6 into the hole 3 of the disclosed mounting and dismounting device, one lifts the buckling element 4 for the buckling part 40 to extend into the hole 3. The depth of the buckling part 40 into the hole 3 is adjusted according to the size of the cylindrical body 5 or cylindrical body 6. One is thus able to mount and dismount the cylindrical body 5 and the cylindrical body 6 in the same way.

According to the above description, it is apparent that the primary features of the invention is in that the fixing element 1 and the moving element 2 can be connected or disconnected with the positioning axis 23. If the open end of the cylindrical body is blocked such that it cannot be inserted into the hole 3, one can simply separate the fixing element 1 and the moving element 2 on one end, put the cylindrical body in, and then use the positioning axis to lock it. In comparison with the prior art, the disclosed mounting and dismounting device makes the mounting and dismounting task much easier. Moreover, by extending the buckling part 40 on one end of the buckling element 4 into the hole 3 and lifting the lifting part 41 in the rotating direction, cylindrical bodies of different sizes can be urged. Therefore, the user only needs to carry one of the disclosed mounting and dismounting devices to mount and dismount cylindrical bodies of all sized. The disclosed mounting and dismounting device is thus more convenient than the conventional one.

Figure 6:
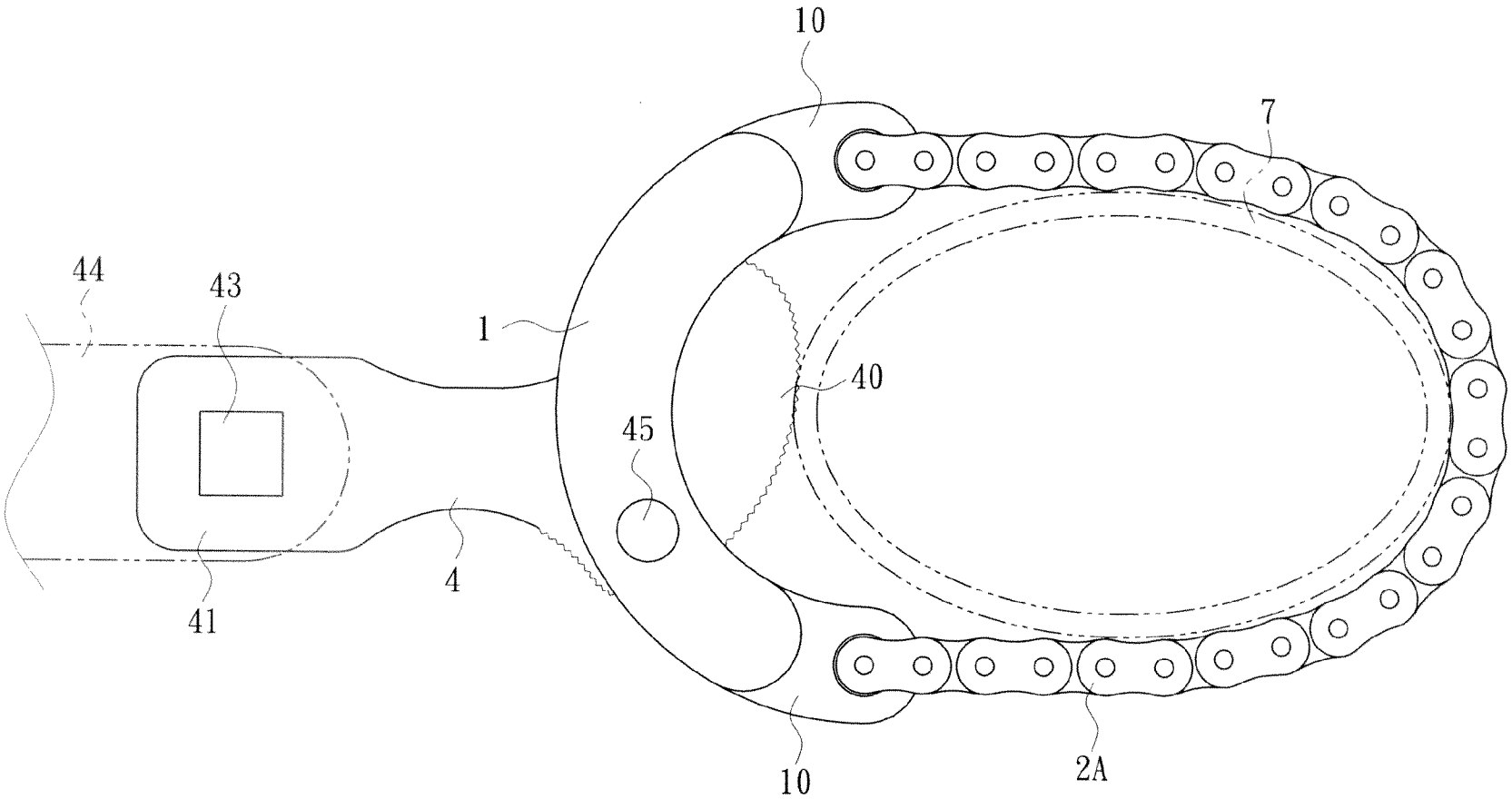
FIG. 6 is a schematic view of mounting and dismounting an irregular cylindrical body according to the second embodiment.
Figure 7:
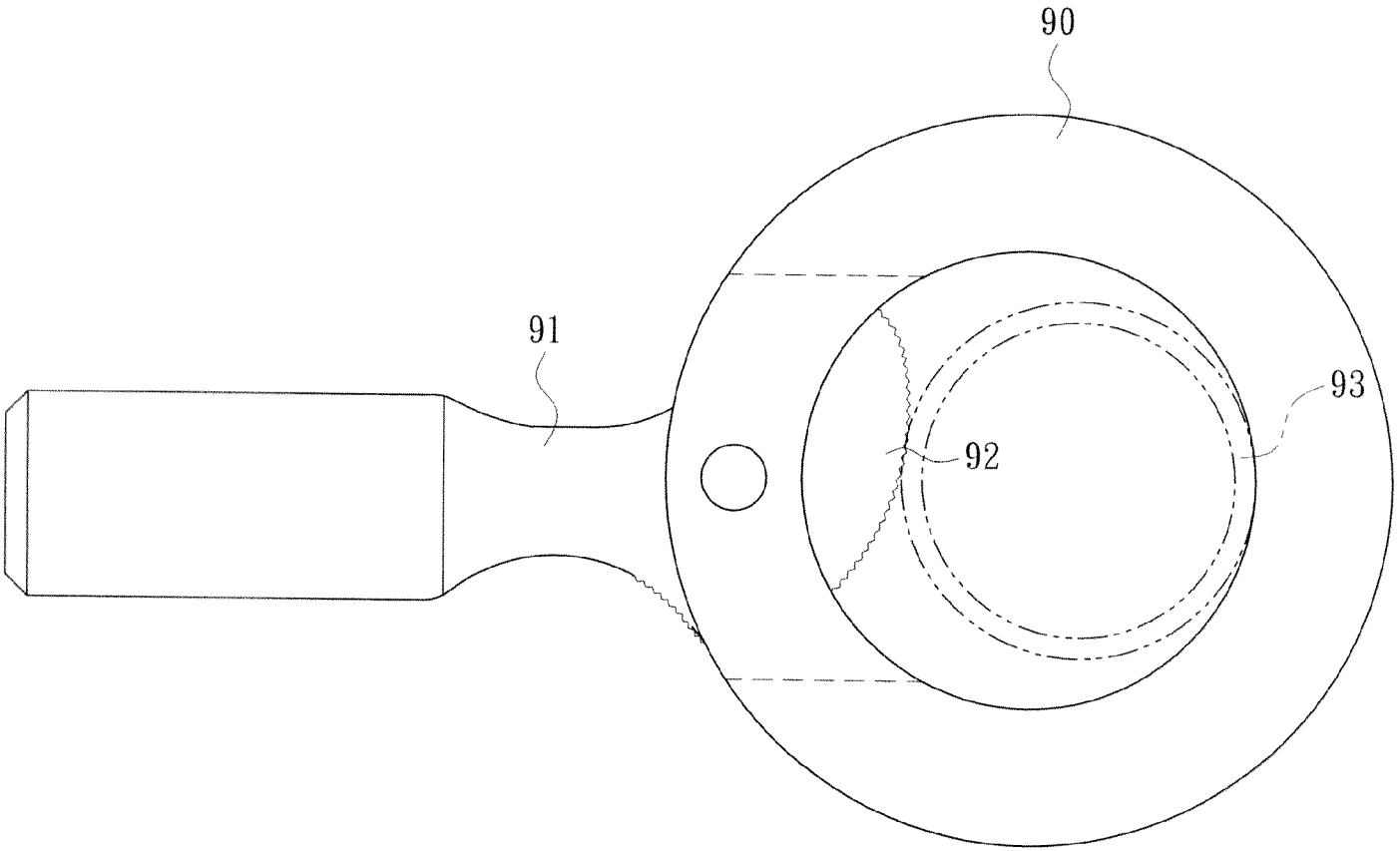
FIG. 7 PRIOR ART
FIG. 7 is a three-dimensional view of a conventional mounting and dismounting for cylindrical bodies.

Of course, the invention has many other embodiments that only differ from the above one in details. FIG. 6 shows a second embodiment of the invention. The fixing element 1 is still an integrally formed block structure. The moving element 2A is now a chain. As shown in the drawing, the cylindrical body 7 has an elliptical shape. Since the chain as the moving element 2A can change its length, the cylindrical body of such a shape can still be urged, thereby mounted or dismounted.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A mounting and dismounting device for a cylindrical body, comprising:

a fixing element in a semicircular shape, whose both ends extend outward a protruding part, respectively; wherein each of the protruding parts has a first through hole in the longitudinal direction, a horizontal groove penetrates through both sides of the fixing element, and one end of the horizontal groove has a second through hole through the horizontal groove;

a moving element in a semicircular shape, whose both ends have a recess part inward, respectively; wherein the two protruding parts of the fixing element are embedded in the two recess parts, both ends of the moving element have a third through hole through the recess part, respectively, the first through hole on the protruding part is connected with the corresponding third through hole, a pivotal axis and a positioning axis go through the connected first through hole and third through hole so that a hole forms in the fixing element and the moving element for the cylindrical body to mount, and the positioning axis is inserted into or withdrawn from the first through hole and the third through hole; and a buckling element whose one end has a buckling part in the shape of a cam and having teeth around its rim and whose other end has a lifting part that lifts when urging, wherein the buckling part has a fourth through hole in the longitudinal direction and a mounting hole for an auxiliary tool to connect and to lift, the buckling part of the buckling element extends into the horizontal groove of the fixing element, the fourth through hole and the second through hole of the fixing element are connected and penetrated by another pivotal axis, and when pivotally swinging the buckling part penetrates into the hole in an appropriate depth to urge against the cylindrical body according to the diameter size thereof.

2. The mounting and dismounting device for a cylindrical body as in claim 1, wherein both the fixing element and the moving element have an integrally formed block structure.

3. The mounting and dismounting device for a cylindrical body as in claim 1, wherein the fixing element is an integrally formed block structure and the moving element is a chain in order to mount and dismount a cylindrical body of an irregular shape.

4. The mounting and dismounting device for a cylindrical body as in claim 1, wherein the positioning axis has a ball for positioning that is urged by a compressive spring in the positioning axis.

* * * * *